US012274357B2

(12) United States Patent
Sheridan

(10) Patent No.: US 12,274,357 B2
(45) Date of Patent: Apr. 15, 2025

(54) TABLETOP WITH STORAGE UNIT FOR WHEELED CART

(71) Applicant: Bonnie R. Sheridan, Plymouth, MN (US)

(72) Inventor: Bonnie R. Sheridan, Plymouth, MN (US)

( * ) Notice: Subject to any disclaimer, the term of this patent is extended or adjusted under 35 U.S.C. 154(b) by 308 days.

(21) Appl. No.: 17/955,381

(22) Filed: Sep. 28, 2022

(65) Prior Publication Data

US 2023/0113239 A1 Apr. 13, 2023

Related U.S. Application Data

(60) Provisional application No. 63/250,525, filed on Sep. 30, 2021.

(51) Int. Cl.
*A47B 31/00* (2006.01)
*A47B 13/16* (2006.01)

(52) U.S. Cl.
CPC ..... *A47B 31/00* (2013.01); *A47B 13/16* (2013.01); *A47B 2031/003* (2013.01)

(58) Field of Classification Search
CPC .... A47B 31/00; A47B 13/16; A47B 2031/003
See application file for complete search history.

(56) References Cited

U.S. PATENT DOCUMENTS 5,438,938 A * 8/1995 Meeker ..... A47B 31/00 108/127
5,649,718 A 7/1997 Groglio
6,669,214 B1 * 12/2003 Domis ..... B25H 3/00 280/47.35
6,916,028 B2 7/2005 Shapiro
7,281,731 B2 10/2007 Shamah
7,284,393 B1 10/2007 Macmillan
7,316,407 B1 1/2008 Elden
7,334,802 B2 2/2008 Kaplan
7,547,027 B2 * 6/2009 Bohn ..... A61H 3/04 280/87.021
7,914,015 B2 3/2011 Tompkins
8,453,771 B1 6/2013 Hirschfeld
8,814,199 B2 8/2014 Shindelar et al.
8,844,756 B2 9/2014 Beyburg
8,844,949 B2 9/2014 White et al.
(Continued)

FOREIGN PATENT DOCUMENTS

EP 1655196 B1 4/2010

OTHER PUBLICATIONS

"MacSports Collapsible Outdoor Utility Wagon with Folding Table and Drink Holders, Maroon" Amazon, <https://www.amazon.com/Mac-Sports-Collapsible-Outdoor-Utility/dp/B01C6D6LUG/ref=pd_rhf_ee_s_vtp_ses_clicks_nonshared_3/138-6722613-6462>, Accessed Oct. 14, 2021.

*Primary Examiner* — Bryan A Evans
(74) *Attorney, Agent, or Firm* — WESTMAN CHAMPLIN & KOEHLER, P.A.; Amanda M. Prose

(57) ABSTRACT

A tabletop supported on the frame, wherein the plurality of storage compartments are provided below the tabletop and wherein the plurality of storage compartments comprise at least one soft-sided bucket for storage and the tabletop comprises a hard flat surface. The tabletop may be provided on a dedicated, collapsible frame or the tabletop may be provided for use with a preexisting wagon or cart.

16 Claims, 10 Drawing Sheets

(56) References Cited

U.S. PATENT DOCUMENTS

| | | | | |
|---|---|---|---|---|
| 8,905,411 | B1 | 12/2014 | Blanton | |
| 9,211,899 | B2 | 12/2015 | Beauchamp et al. | |
| 9,266,547 | B2 | 2/2016 | Schumaker et al. | |
| 9,623,890 | B1 * | 4/2017 | Horowitz | B62B 3/007 |
| 9,809,376 | B2 | 11/2017 | Mitchell et al. | |
| 10,307,322 | B2 * | 6/2019 | Andersen | A61H 3/04 |
| 11,084,513 | B1 * | 8/2021 | Tschiggfrie | B62B 3/02 |
| 11,457,727 | B1 * | 10/2022 | Weber | A47B 3/10 |
| 2007/0273113 | A1 * | 11/2007 | Muir | B62B 3/1468 280/33.992 |
| 2012/0074664 | A1 | 3/2012 | Henny et al. | |
| 2013/0049311 | A1 | 2/2013 | Metters et al. | |
| 2017/0215348 | A1 | 8/2017 | Burmann | |
| 2018/0361266 | A1 | 12/2018 | Smith | |

* cited by examiner

TABLETOP WITH STORAGE UNIT FOR WHEELED CART

This application claims priority to and the benefit of U.S. provisional application Ser. No. 63/250,525, filed on Sep. 30, 2021, the contents of which are incorporated herein in their entirety.

BACKGROUND

The present invention relates to a combination tabletop and wheeled cart for storage and transport. More specifically, the present invention relates to a foldable or collapsible wheeled cart having a tabletop surface with one or more cup holders.

SUMMARY

An aspect of the present disclosure relates to a multi-use cart. The cart has a collapsible framework with a pair of adjacent and spaced apart front side supports and a pair of adjacent and spaced apart rear side supports, the front and rear supports also spaced apart so as to provide an open space within the framework. The cart further includes a plurality of storage compartments supported on the frame and a tabletop supported on the frame. The plurality of storage compartments are provided below the tabletop and wherein the plurality of storage compartments comprise at least one soft-sided bucket for storage and the tabletop comprises a hard flat surface.

The frame has a height and wherein the side supports are collapsibly connected such that in a collapsed position the open space within the framework has first dimensions and in an expanded position the open space within the frame work has second dimensions wherein the second dimensions are greater than the first dimensions and wherein the frame further comprises at least one locking mechanism to secure the frame in one or both of the expanded and collapsed positions.

The plurality of storage compartments comprises a plurality of soft sided buckets, pockets, bags or a combination thereof vertically spaced apart along the height of the frame work and positioned within the open space within the framework.

The table top is positioned at a top portion of the framework and is supported over the open space and storage compartments there below.

The plurality of storage compartments comprise storage compartments comprised of fabric, canvas, mesh or a combination thereof.

The tabletop is a molded plastic material and wherein the tabletop comprises one or more recesses configured to vertically support a beverage container thereon.

The tabletop further comprises a raised perimeter lip.

The tabletop comprises a first substantially flat surface and a second substantially flat surface wherein the second substantially flat surface is provided to increase a surface area of the tabletop when the second substantially flat surface is in use.

The tabletop comprises a first substantially flat surface and a second substantially flat surface wherein the second substantially flat surface is provided to increase a surface area of the tabletop when the second substantially flat surface is in use and wherein the second substantially flat surface extends beyond the frame when in use.

The frame is a wheeled frame comprising one or more all-terrain tires.

The plurality of storage compartments further comprises one or more bags, pockets, buckets, coolers or combinations thereof and wherein the one or more bags, pockets, buckets, coolers or combinations thereof are secured to only one side support or between only one pair of adjacent side supports.

The plurality of storage compartments are usable concurrently with the tabletop and while pushing the wheeled frame.

Another aspect of the present disclosure relates to a tabletop for a wheeled cart. The tabletop has a top surface for supporting one or more items thereon, the top surface comprising a substantially flat surface area, a raised perimeter edge to the top surface, and one or more cavities in the top surface configured for holding a beverage container and two or more legs pivotally connected to a bottom surface of the tabletop wherein the two or more legs are positioned to support the tabletop on two or more sides of the tabletop. The tabletop further has one or more storage compartments secured to the tabletop and positioned on one or more sides of the tabletop to provide storage adjacent to the tabletop. The tabletop and the one or more storage compartments secured thereto are constructed from different materials.

The legs extend outwardly from connection with the bottom surface of the table top at an angle and wherein the legs have a length such that the tabletop is configured to fit within an open area on a support surface of a wheeled cart and be supported therein for converting the wheeled cart to a wheeled tabletop.

The one or more storage compartments extend along one or more perimeter sides of the tabletop and hang therefrom.

The one or more legs are adjustable in length.

The table top includes a coupling mechanism provided around a perimeter of the table top and configured for removable coupling to a corresponding coupling mechanism provided on an upper surface of one or more storage components such that the arrangement of one or more storage components coupled to the table top is customizable.

In one or more embodiments, the tabletop has one or more straps for the one or more legs and configured to secure the one or more legs to a surface of the wagon or wheeled cart.

A distance between adjacent legs is adjustable for installing the tabletop on the wagon or wheeled cart in a manner wherein the legs are secured to the wagon or wheeled cart by way of direct contact with one or more upright surfaces of the one or more legs with one or more surfaces of the wagon or wheeled cart.

The table top is configured to be supported on a floor surface of a wheeled cart and wherein a vertical spacing between the floor surface and the table top is adjustable by way of adjusting a length of the one or more legs such that items of varying dimensions may be supported on the floor of the wheeled cart while the tabletop is supported thereon.

In one or more embodiments, the table top comprises two sections that are hingedly connected such that the table top is foldable.

In one or more embodiments, the table top surface comprises one or more access openings having a section of table top surface pivotally connected to the table top such that the access opening comprises a door providing access to an interior of the cart below the table top.

DETAILED DESCRIPTION

Figure 1:
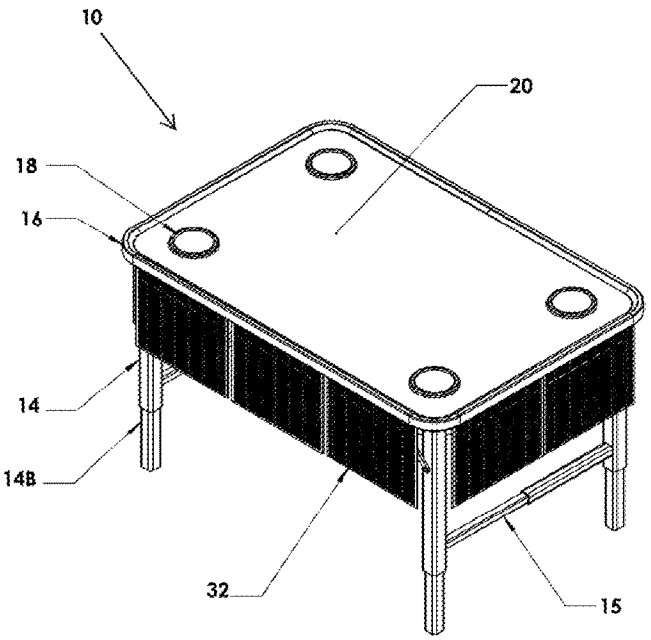
FIG. 1 is a side perspective view of a combination storage tabletop for a wheeled cart.
Figure 2A:
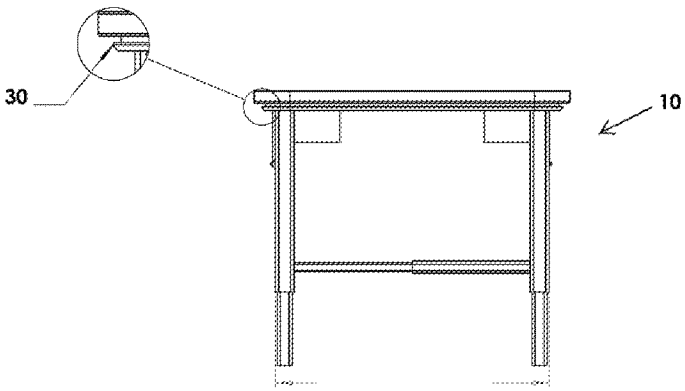
FIGS. 2A and 2B are front and side views of the tabletop with the storage removed therefrom.
Figure 3:
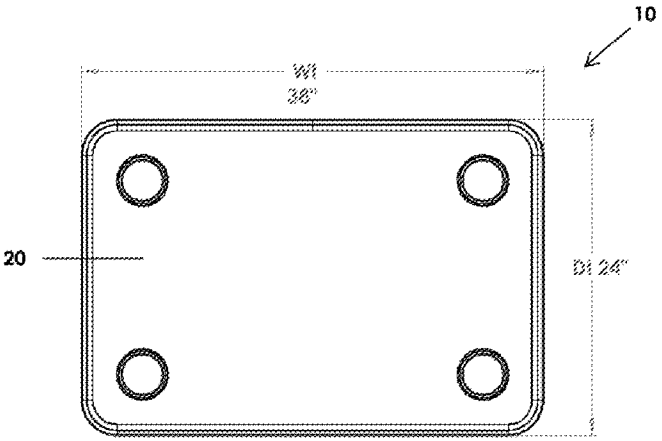
FIG. 3 is a top view of the tabletop.
Figure 2B:
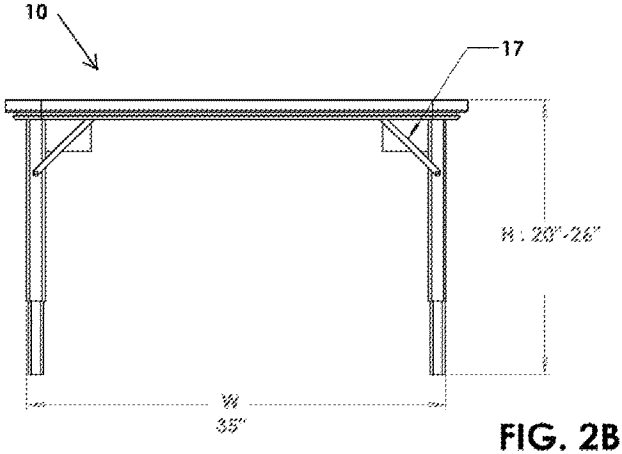
Figure 4:
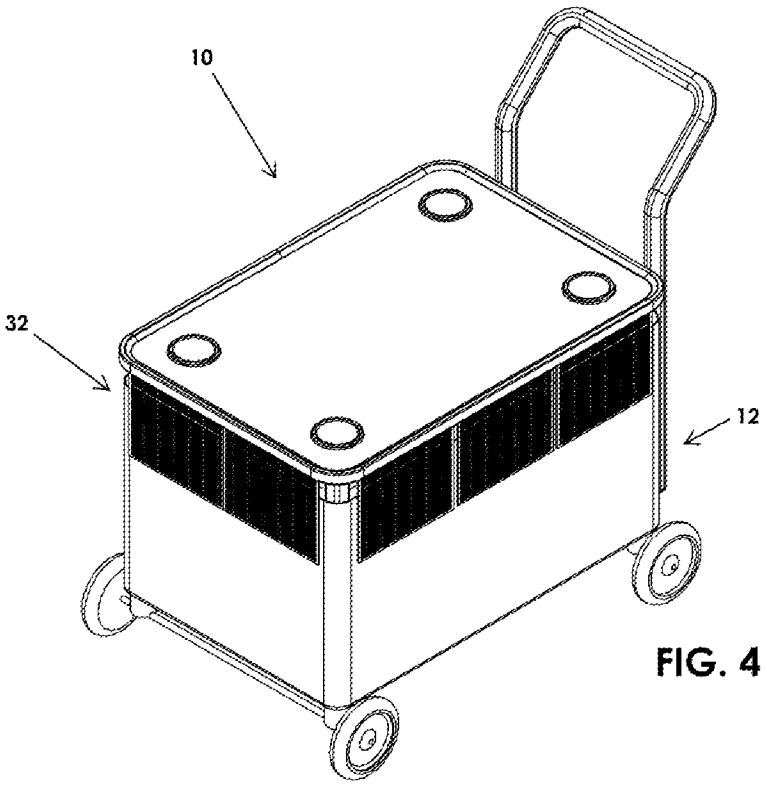
FIG. 4 is a side perspective view of the combination storage tabletop positioned on a wheeled cart.
Figure 5:
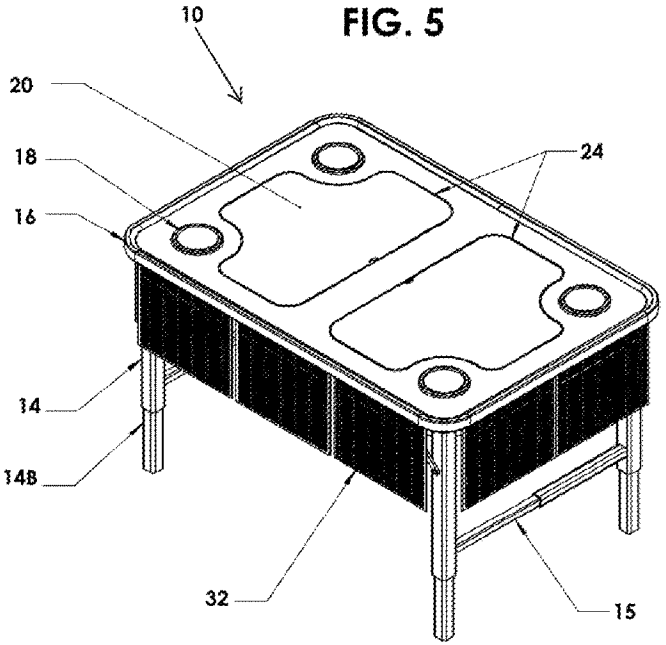
FIG. 5 is a side perspective view of a combination storage tabletop for a wheeled cart.
Figure 6A:
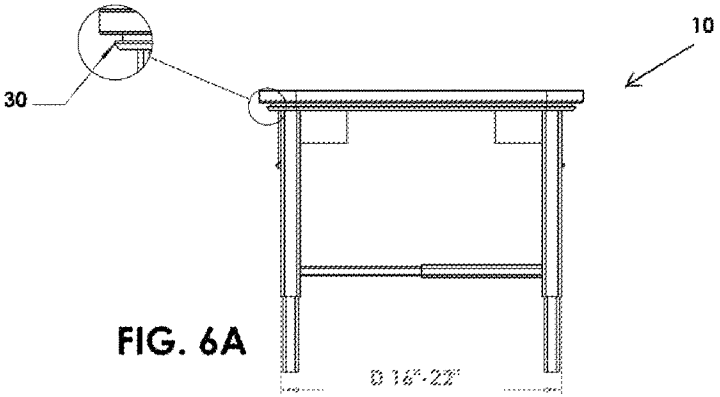
FIGS. 6A and 6B are front and side views of the tabletop with the storage removed therefrom.
Figure 6B:
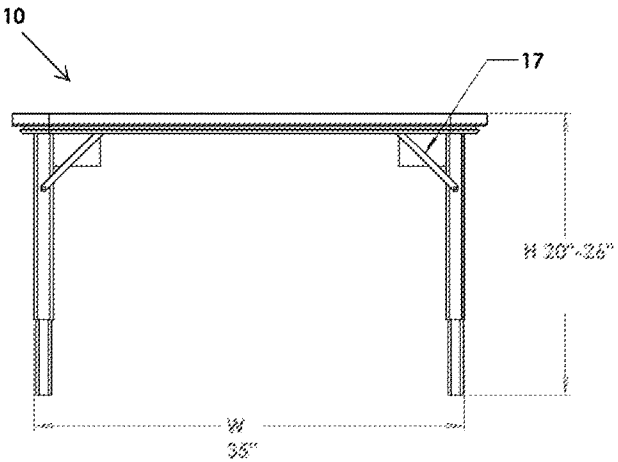
Figure 7:
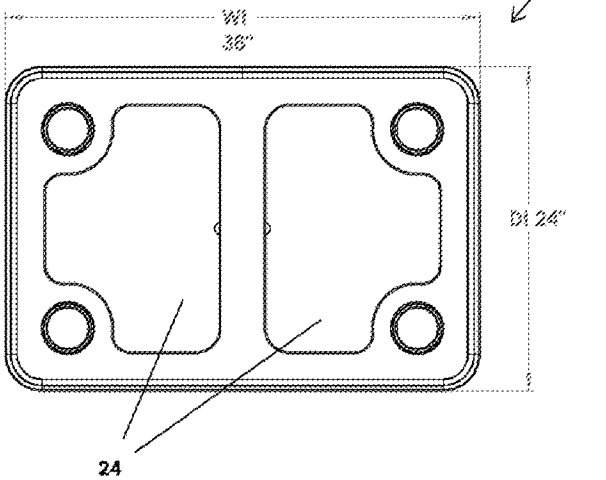
FIG. 7 is a top view of the tabletop.
Figure 8:
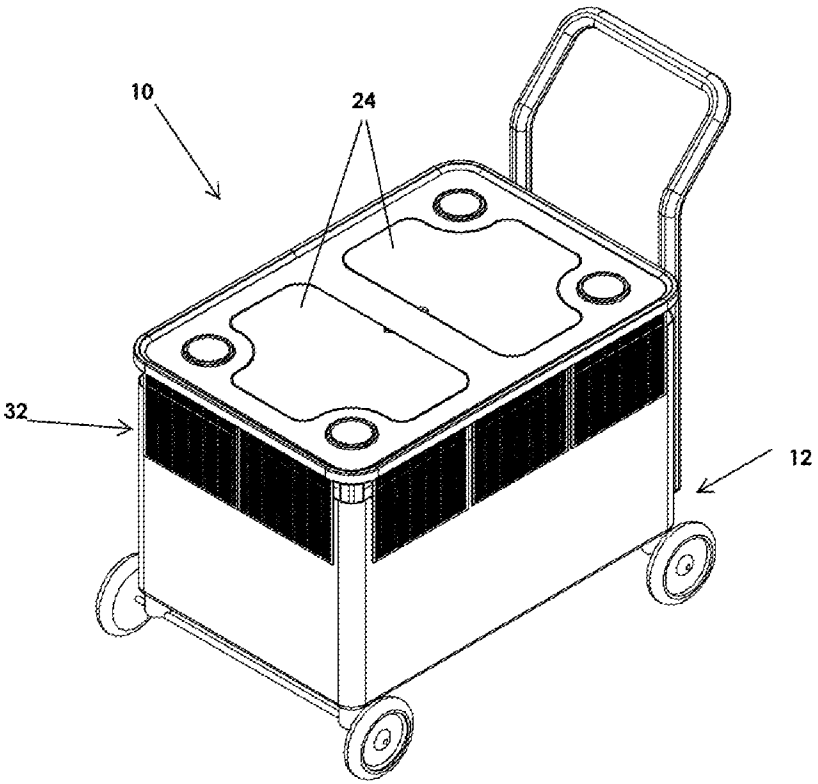
FIG. 8 is a side perspective view of the combination storage tabletop positioned on a wheeled cart.
Figure 9:
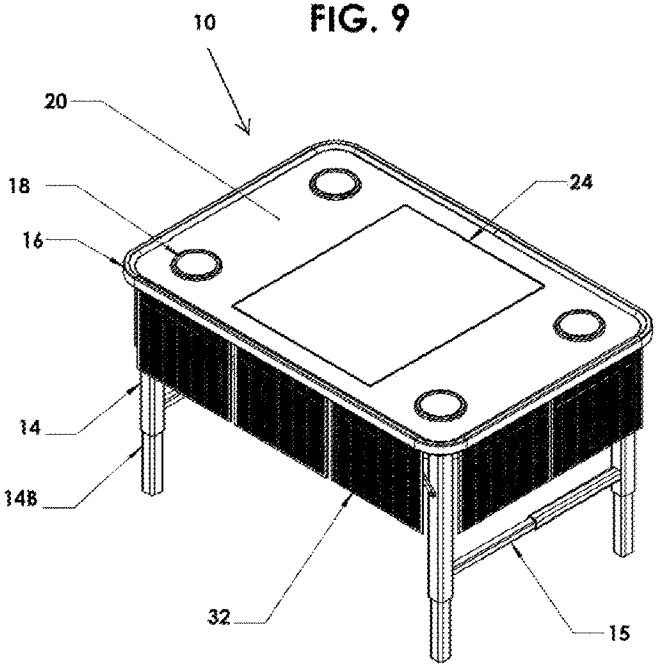
FIG. 9 is a side perspective view of a combination storage tabletop for a wheeled cart.
Figure 10A:
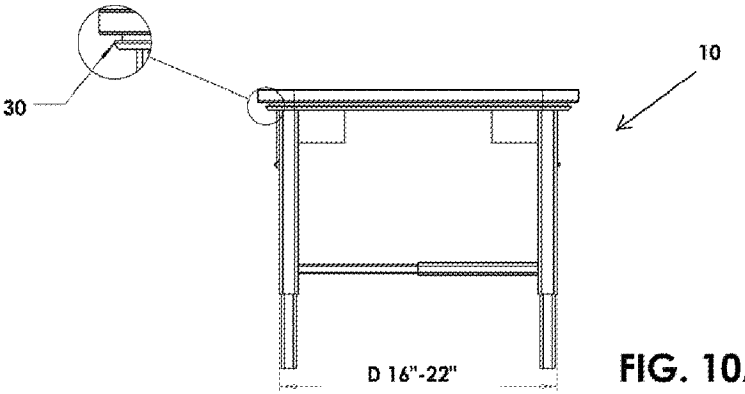
FIGS. 10A and 10B are front and side views of the tabletop with the storage removed therefrom.
Figure 11:
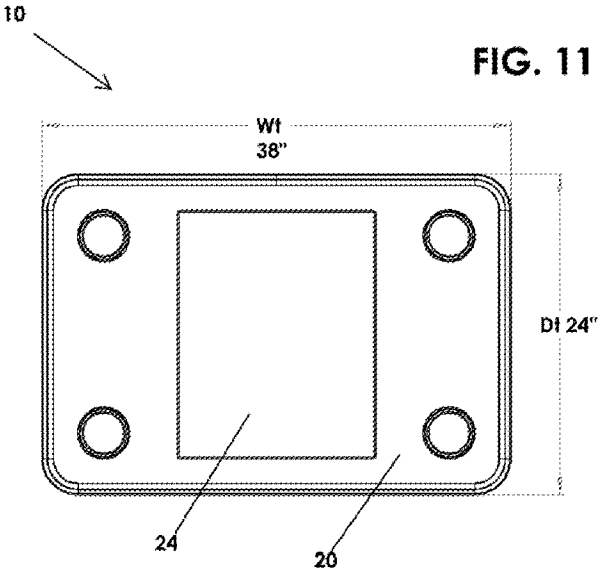
FIG. 11 is a top view of the tabletop.
Figure 10B:
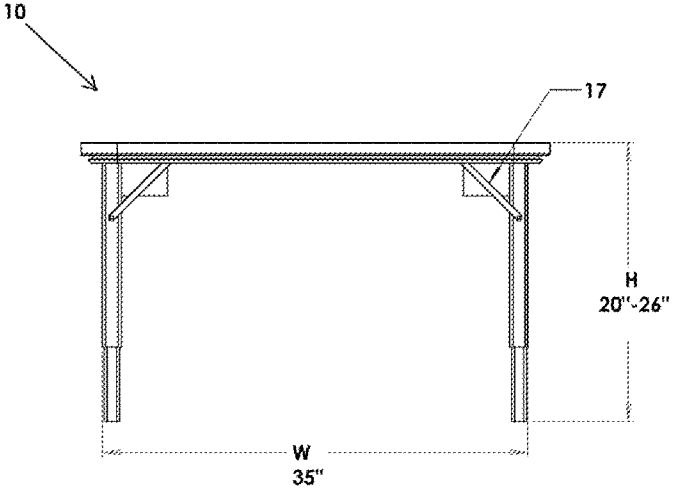
Figure 12:
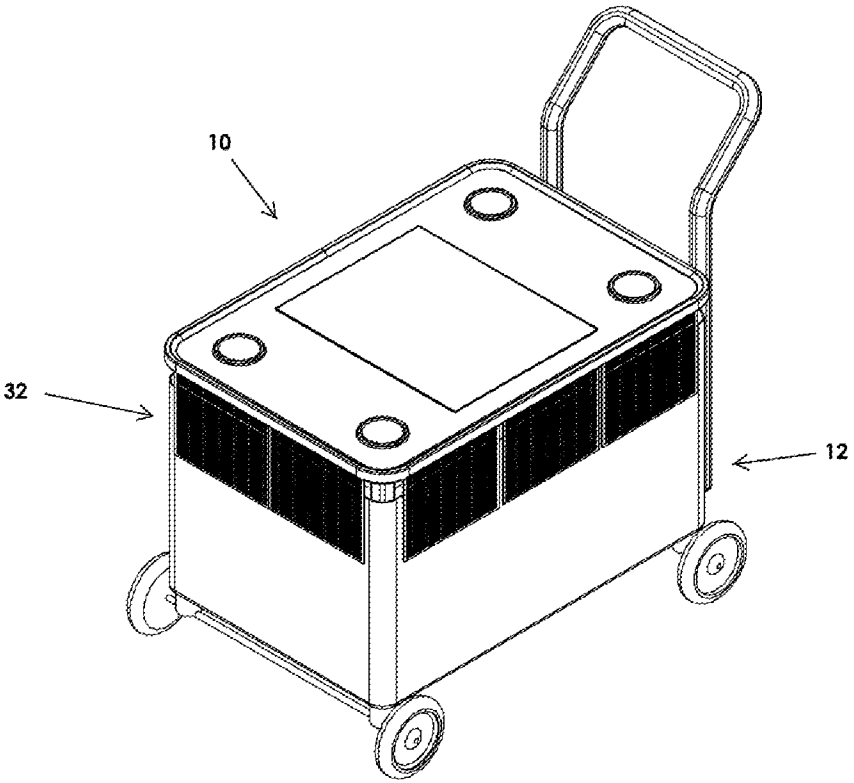
FIG. 12 is a side perspective view of the combination storage tabletop positioned on a wheeled cart.

A cart for providing a support surface for dining, storing and transporting of various goods is described herein. The cart may be an upright push cart having a frame that supports one or more levels of storage with an upper surface configured as support surface for dining. This upper surface may be referred to as a tabletop. The frame may also be collapsible or foldable allowing for compact storage or transport of the cart itself. The push cart is configured with a plurality of compartments to allow for the holding of various goods and an upper surface of the cart may be a tabletop. Thus, the cart according to one or more embodiments described herein allows a user to use the cart to transport various shaped and sized goods and concurrently use the tabletop to hold goods while using those goods.

The cart may support a combination of soft sided storage surfaces and molded storage and support surfaces to allow the cart to be collapsed when not in use. The cart may also support a plurality of storage solutions which comprise one or more of pockets, buckets, cupholders, bottle holders, coolers, bags, and combinations thereof. One or more of the storage solutions may be removably connected to the cart, frame, or other storage solutions to allow for selected customization of the cart with each use.

The tabletop may be a molded component having a generally hard and/or flat surface for supporting items resting thereon, one or more recesses, such as cup holders, and a perimeter rim to prevent items resting on the flat surface from rolling off the tray for example. In one or more embodiments, the tabletop comprises a second substantially flat surface that is a "pop out" surface to extend the overall surface area of the table top. The second surface for example may be parallel to the first flat surface and stored directly there below when not in use. As such, a mechanism allows the second surface to pop out from below the first surface to provide additional surface area which extends outwardly from the cart. Additionally, or alternatively, the second surface may be a fold out surface which is hingedly connected to the first surface and folds out to provide additional surface area to the tabletop. The first surface may also comprise two subparts allowing the first surface to be foldable along a center line for storage. The second surface may similarly be constructed.

The frame is a collapsible frame such that the frame can be moved between at least two positions, a first position for storage wherein the frame is collapsed, and the unit is compacted and a second position for use wherein the frame is opened and the unit is expanded. In the position for use, the frame is locked at one or more collapsible connection points to secure the frame in an upright and expanded position for use. Additional locks may be provided to secure the frame in the collapsed position for storage.

In one or more embodiments, the frame supports each level of storage within a perimeter of the frame wherein the storage solutions are vertically stacked along a height of the frame and wherein the tabletop is provided as top surface to the frame. The tabletop may have dimensions such that a width and depth of the tabletop are substantially equal to the width and the depth of the frame as provided in an open position for use.

Additionally, or alternatively, the tabletop may have dimensions such that a width and depth of the tabletop are substantially equal to the width and the depth of an upper end of the frame as provided in an open position for use and less than a width and a depth of a lower end of the frame. The tabletop is generally provided in a position above, over or on top of one or more storage solutions. The tabletop and storage solutions may each have varying dimensions such that the frame supports these elements in a generally upright and stacked manner, but the components may be offset or aligned along a vertical axis.

The cart is also a wheeled cart wherein one or more of the wheels comprise "all terrain" tires to allow for use of the cart in various environments and terrains. The wheels may in some embodiments be connected to the frame by casters which allow for easier turning and multi-directional movement of the cart in use.

The frame of the cart may also have dimensions such that the frame has a larger width and/or depth at its base as compared to the width and/or depth at or near the top of the frame such that in an upright position the cart has a wider base to support the storage and tabletop vertically thereon. Alternatively, the cart may have a substantially consistent width and depth along its height. It is also contemplated and within the scope of this disclosure that the cart is an upright cart or generally upright cart where one or more supports or sides of the frame are angled or inclined for load support, mobility and/or ease of use.

The frame may also include a handle portion for ease of use and steered movement of the cart. The handle may be provided with a comfort grip and/or ergonomic shape.

In the embodiments described herein the tabletop is configured to support items including, but not limited to food and beverages. The table top may be removably connected to the cart or to the frame and/or may be hingedly connected to the frame. The table top may be supported above the cart or the frame and/or in such a manner that the cart is positioned generally at a top of the storage option or spaced there above such that tall items in the cart or frame may be stowed and the table top still usable. The multi-level storage options on the cart allow a user to store items in the cart while pushing the cart and use the tabletop to support food and/or beverage while also pushing the cart as well as when the cart is stationary. While the description herein is directed to portable or transportable solutions for combination storage and tabletop support surfaces, use of the devices described herein are not so limited.

The devices according to one or more embodiments may be used for storage and transport as well as providing a dining support surface tabletop in environments including but not limited to the beach, fairs, airports, or parks. That is, a user may store the items needed for their endeavor and/or items purchased during their endeavor and concurrently use the tabletop to hold food and drinks when eating and drinking.

In one or more embodiments a tabletop component and one or more compartments for storage may be provided without the cart frame described herein and instead can be used with a pre-existing wagon style cart or similar wheeled device or push cart. In such an embodiments, the device comprises a portable and collapsible tabletop that is configured to fit into a pre-existing wagon. The height of the table top above a support floor or support surface of the wagon style cart or similar wheeled device may be adjustable and selectable via extendable legs having one or more selectable lengths.

In one or more embodiments, the tabletop does not require legs or extendable legs for securing the tabletop to a wagon or wheeled cart. For example, a perimeter surface and/or bottom of the table top may be provided with fasteners such as a clips or hooks that allow for the mounting of the tabletop to one or more surfaces, walls and/or sides of the preexisting wagon. Additional mechanisms can include tension rods and the like which allow for mounting to hard walls of a wagon with or without the use of legs provided on the tabletop.

In one or more embodiments described in further detail and illustrated in FIGS. 1-12, a collapsible combination storage tabletop 10 is provided for removable installation on a pre-existing wheeled cart, wagon, or other movable seating or storage platform 12.

The tabletop 10 is provided with one or more leg components 14 which may be pivotally connected to a bottom surface of the tabletop 10. The legs 14 may collapse to allow the tabletop 10 to be compacted for storage. The leg components 14 may also be extensible via extensions 14B such that a length of the leg 14 component for use may be selected, allowing the tabletop 10 to have an adjustable position or height over the cart or wagon 12. One or more cross-bars 15 may be provided and connect two adjacent legs for added adjustability and/or stability as well as for adjusting the distance between the legs 14. Additional adjustment and stability may be provided by way of leg stabilizer(s) 17 which allow for adjusting the width and/or depth of the tabletop 10 when the legs are in an open and supportive position for installation on the wagon or cart. Thus, the tabletop 10 may be an adjustable and customizable tabletop 10 by way of selectable dimensions of the space below the tabletop surface 20 and bounded by the legs 14. The height, width and/or depth of this space may each individually and collectively be adjustable. This allows the wagon or cart 12 to carry items of various sizes and dimensions without precluding the use of the tabletop 10 and including carriage of items extending above side walls of the wagon or cart 12.

The adjustable legs 14 allow the tabletop 10 to fit 'tightly' in most standard size wagons and positioning of the legs 14 within the wagon in a manner where the tabletop 10 is stable and does not "rock" or otherwise move when the wagon or cart is moved or in motion.

Additionally or alternatively, the tabletop 10 may be provided with a strap provided on one or more legs 14 of the tabletop 10 and configured to secure to a surface of the wagon such as one or more bars on the folding wagon or supports for the wagon or cart.

For example, in one non-limiting embodiment, height H of the tabletop 10 may be adjustable in the range of about 20 inches to about 26 inches in one embodiment when having a width W of about 35 inches and an adjustable depth D in the range of about 16 inches to about 22 inches. In such an embodiment, the tabletop surface 20 may have a width Wt of about 38 inches and a depth Dt of about 24 inches.

The tabletop 10 may be a hard molded plastic construction, a scratch resistant plastic or other durable, lightweight and easily cleanable material and may be provided with a perimeter lip 16 and one or more apertures 18 for holding beverage containers in an upright position thereon. The tabletop 10 may also be comprised of a fabric material and/or have a silicone, rubber, or other layer or coating thereon. The tabletop 10 may also be comprised of a combination of plastic, resin, fabric (e.g., canvas, nylon, cotton, spandex, and blends or mixtures thereof), silicone, rubber or other material for texture, durability and cleanability. The tabletop 10 has a generally flat surface 20 that may be provided with a texture at one or more locations thereon to aid in holding items placed thereon when in use. In one or more embodiments, the table top 10 may have a hinged connection 22 of two sections such that the table top 10 can be folded or collapsed when not in use.

The tabletop 10 surface may also be provided with one or more of an access door 24 which allows a user to easily access storage or items in the cart or wagon stored below the tabletop 10.

The tabletop 10 may also be provided with a mechanism 30 for removably connecting to and supporting one or more storage components 32 on the tabletop 10. For example, the perimeter of the tabletop 10 may be provided with a ledge, channel or other mechanism surrounding the perimeter which allows for connecting storage component(s) 32 to the tabletop 10 via clips, hooks, pins, or similar mechanisms secured to the storage components 32.

Figure 13A:
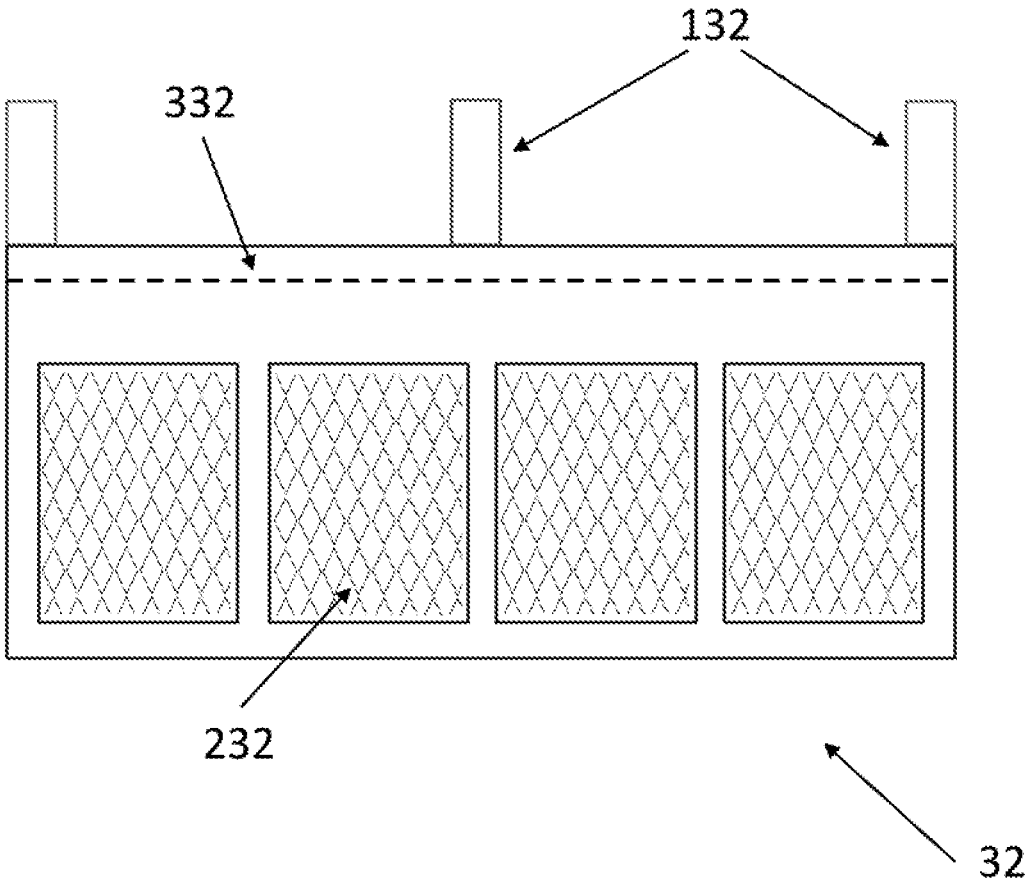
FIGS. 13A-C illustrate various storage components for the tabletop and/or storage cart described herein.
Figure 13B:
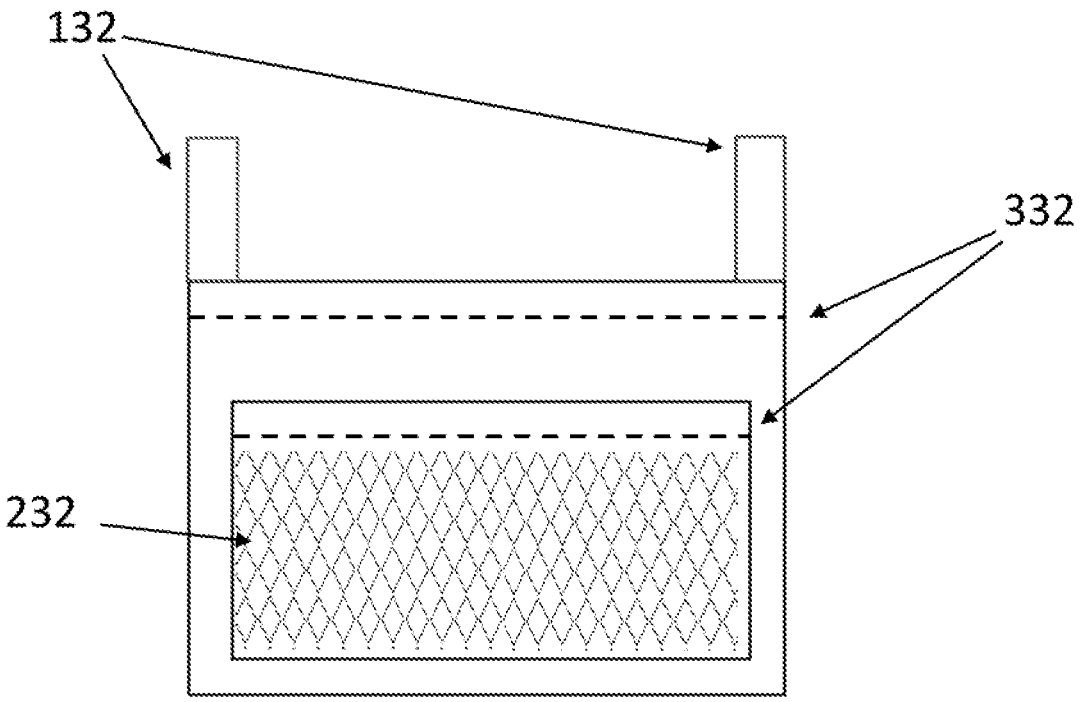
Figure 13C:
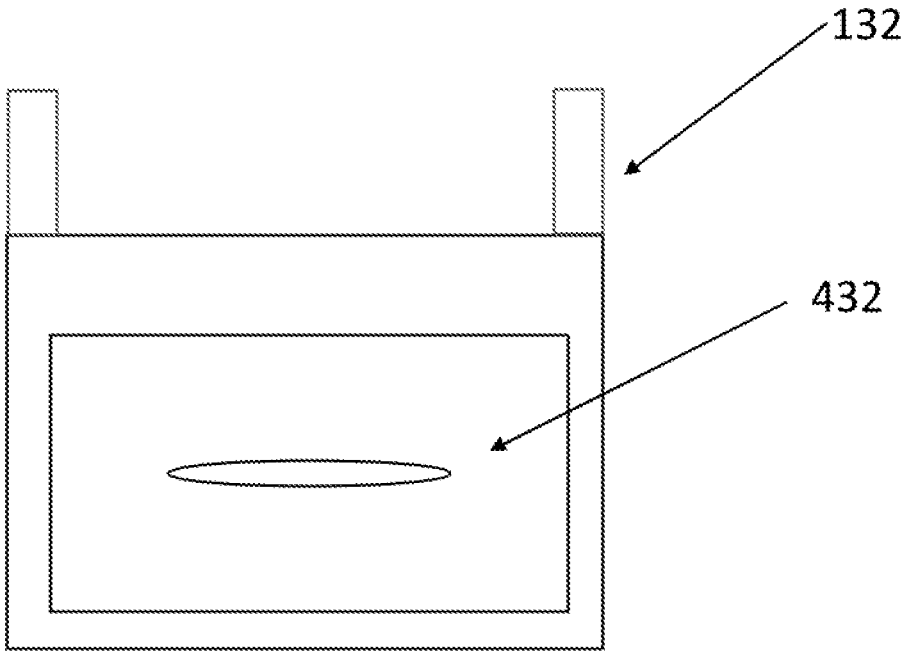
Figure 14:
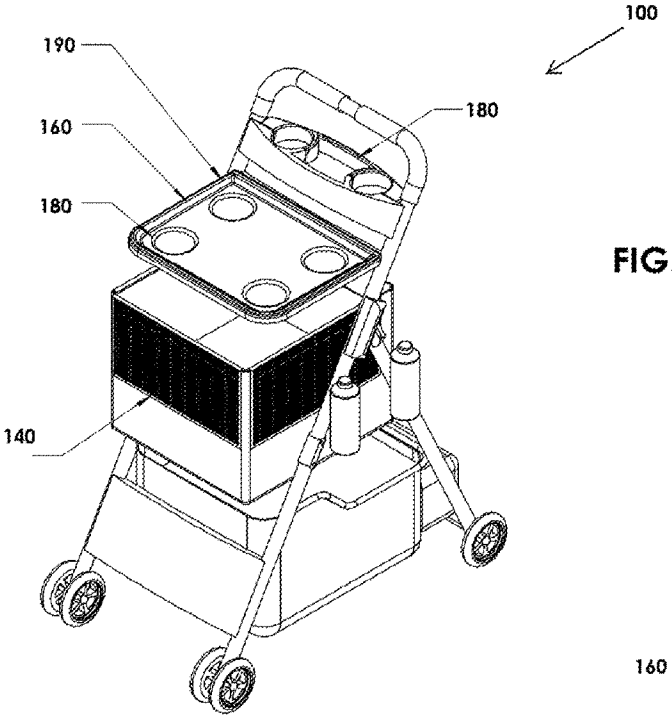
FIG. 14 is a perspective of a collapsible combination tabletop and wheeled storage cart.
Figure 15:
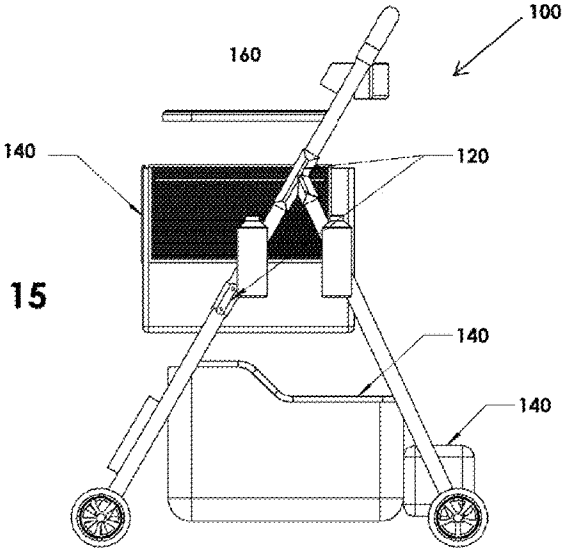
FIG. 15 is a rear view thereof.
Figure 16:
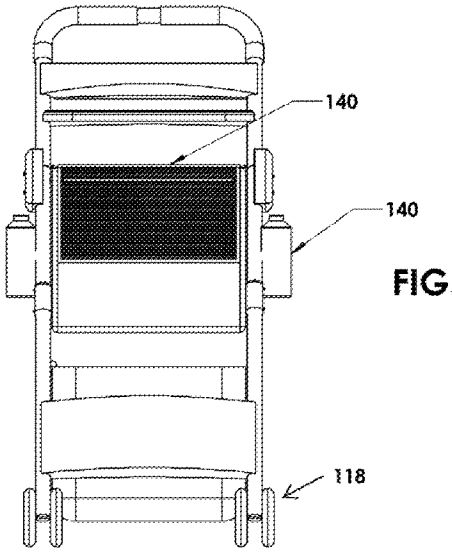
FIG. 16 is a side view thereof.
Figure 17:
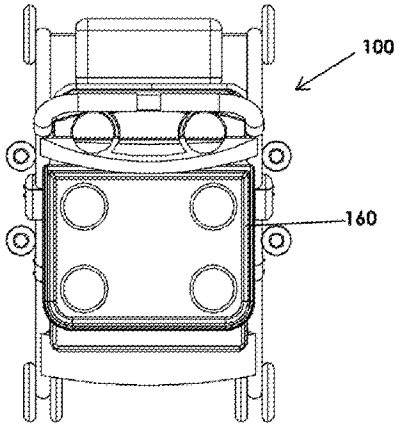
FIG. 17 is a top view thereof.

The tabletop 10 may then also be provided with a plurality of storage compartments 32 of various type, style and construction. Examples of storage compartments 32 are illustrated in FIGS. 13A-C. The compartments 32 may, for example, comprise one or more pockets, bags, holders, or combinations thereof. The storage components 32 may be comprised of canvas, mesh, elastic and/or stretchable fabrics, as well as and materials that provide for easy access and/or cleaning, or combinations thereof. The compartments 32 may be provided with straps 132 that are configured to couple to otherwise clip into the mechanism 30 on the tabletop 10 or secure but removable connection thereto. The storage compartments 32 may have access openings which provide self-closing pockets, mesh pockets 232, zippers and/or zippered pockets or openings 332, easy access pockets for moist wipes 432, elastic components which include elastic nets and/or mesh, ties, and other mechanisms for storing, holding and securing items of various sizes and configurations thereto. The one or more storage components 32 may be removably secured to the outer perimeter of the tabletop 10 such that the storage components 32 hang therefrom.

In one embodiment, the tabletop 10 is lined with a hanging curtain 36 of storage components 32 and which conceals items stored below the tabletop 10 while the curtain 36 concurrently supports, holds, or provides one or more storage compartments 32 thereon, such as pockets sewn directly thereon or otherwise integrated directly therein. The curtain 36 may be comprised of a canvas material. A top surface of the curtain 36 is configured to secure to the mechanism 30 on the tabletop 10 for securely holding one or more storage components 32. A bottom surface of the tabletop 10 may also be provided with a space and/or mechanism for securing additional storage compartments thereto, such as a soft sided cooler or the like.

The tabletop 10 has dimensions that allow the tabletop 10 to fit inside most preexisting folding wagons 12. The dimensions allow the extended legs 14 to fit securing within a wagon for non-tip use at one or more heights of the table top 10.

In another embodiment, a cart 100 for support, storage, and transport of various goods is illustrated generally in FIGS. 14-17. The cart 100 comprises a collapsible frame 120, one or more storage components 140 of various types and a tabletop 160. The cart 100 is foldable or collapsible such that the cart 100 can be collapsed from a first position, a use position, where the frame 120 is fully opened and expanded and a storage position where the frame 120 is collapsed and compacted.

The frame 120 is a foldable or collapsible frame 120. The frame 120 is comprised of a plurality of interconnected supports such as rods or bars. The frame 120 comprises a first pair spaced apart supports and a second pair of spaced apart supports where the pairs are also spaced apart such that these spaced apart supports provide an overall perimeter shape to the cart. In one embodiment each of these spaced apart supports have a first end terminating in connection with a wheel such that the frame is a wheeled frame 120. Each support may terminate in connection with its own wheel such that four ground surface engaging wheels 180 are provided to the frame 120. However, it is contemplated and within the scope of this disclosure that the wheeled frame comprises two wheels where for example the supports of each of the pairs of supports terminate in connection with the same wheel.

The cart 100 is a foldable and/or collapsible cart such that the cart may be folded and/or collapsed about a connection with each support in one pair or supports and/or may be collapsible or foldable about one or more connections between the pairs of supports.

In the embodiment illustrated, the frame 120 has a generally square foot print where the cart 100 has a width and a depth that are substantially equal when the cart 100 is expanded for use, and wherein the cart 100 has a height that is greater than either the width or the depth. For example, the cart may have a height that is at least two times the width or the depth of the cart 100 when the cart 100 is in a use position. In one or more embodiments, the width and depth may not be equal to one another and the height may be greater than one or both of the width or depth. In the embodiment illustrated the frame 120 provides an upright cart where the cart 100 is generally at a shoulder height of an average sized adult. The cart 100 then supports the tabletop 160 in a horizontal position and at a height in the range of about 36 inches to about 50 inches above a ground surface.

The storage components 32, 140 comprise a combination of storage mechanisms. At least one storage bucket or basket is supported by each of the side supports and thus has a floor that spans substantially the entire width and depth of the cart 100 in the use position. The storage bucket has a height that extends a portion of the height of the frame 100 such that the storage bucket has a depth that is, in one embodiment, approximately half the height of the side supports or less than half of the height of the side supports. The storage bucket or basket is positioned on a lower end of the upright cart frame. There above may be one or more additional storage compartments comprising pockets or bags for example. In one or more embodiments these storage compartments may be secured to a curtain that hangs from connection with the tabletop.

In any of the embodiments described herein, each of the storage components and/or mechanisms may be soft sided or comprised of mesh or canvas materials which enable collapsing of the cart while the storage components remain attached. Additional storage components may include cup holders, insulted coolers, soft-sided coolers, phone, tablet or accessory holders, and combinations thereof. These additional storage components may be comprised of plastic materials or may also be soft sided.

The storage components 32, 140 may be attached directly to the frame 120 at one or more locations via clips, fasteners, snaps, clamps or the like. The storage compartments may be removably attached to the frame 120 for ease of removal and cleaning. The storage components 140 may also be attached to curtains or other flexible materials that are similarly removably attached to the tabletop 16 and hang therefrom or are attached to the frame 120 and that are moveably attached thereto.

The tabletop 160 may be a molded tabletop 160 surface where the tabletop is a hard surface comprised of a plastic or like material. The tabletop thus provides a sturdy, solid surface for supporting items thereon. The tabletop 160 comprises a flat surface for supporting items thereon and having a perimeter lip 190. The surface is substantially flat and may also be substantially smooth, although one or more areas on the tabletop 160 may be textured to provide additional traction for holding items placed on the tabletop 160 while the cart 100 is in motion or use. The tabletop 160 may also be integrally formed with one or more apertures 180 for supporting a beverage container in an upright position therein. In one or more embodiments described herein, including tabletop 10 above, the apertures 18, 180 may support a collapsible floor for holding a base of a beverage container upright on the tabletop 160. For example, the apertures may support a collapsible cup holder body 180 which extends downwardly from connection with a surface of the aperture, a perimeter of the aperture, and/or the tabletop 160 bottom surface around the aperture. The collapsible cup holder body may be comprised of canvas, mesh or a like material, the collapsible cup holder body may be comprised of an accordion style body made from a bendable and resilient body such as silicon, and/or the collapsible cup holder body may be comprised of telescoping molded plastic components such that the cup holder body also collapses when the cart 10 is collapsed for storage, for example.

The table top 160 may also have one or more sections that are hingedly connected, slidably connected, or otherwise operably connected such that the table top 160 may be foldable along one hinged connection and or may have extendable surface areas via a slidable or other connection of surface areas. The tabletop 160 may be removably attached to an upper end of the frame 120 to provide a top to the cart 100. The tabletop 160 may be attached directly to the frame via clips, fasteners, clamps, apertures in corners of the tabletop surface which receive corresponding ends of the frame 120 supports, or combinations thereof. Additionally, or alternatively, the tabletop 160 may be pivotally or hingedly attached to the frame 120 so that the tabletop can be folded down and remain attached to the cart 100 when the cart 100 is collapsible for storage.

The tabletop 160 comprises a flat surface as described above. In one or more embodiments, the tabletop 160 may comprise a second flat surface that is slidable or pivotally attached to the flat surface and provides extended tabletop 160 surface when in use. The second flat surface may be constructed in substantially the same manner as the first flat surface or may be a continually flat surface. The second surface may be slidably or hingedly attached below the first surface of the tabletop and configured to pop out when in use or the second surface may be pivotally attached to the first surface to fold out.

A handle 200 may be provided at one or more locations on the cart 100 for pushing, pulling and/or steering the cart 100. The handle 200 may be hingedly attached to the frame 120 such that the handle height and positioning can be adjusted and/or so that the handle 200 can be folded down when collapsible the cart 100. The handle 200 may also be provided with a grip portion for comfort.

In use, the cart 100 provides a tabletop 160 surface for eating, for example, and the tabletop 160 can be used when the cart 100 is stopped and when the cart 100 is in motion. Concurrently, the cart 100 provides this moveable tabletop and multiple storage solutions.

Although the present disclosure has been described with reference to preferred embodiments, workers skilled in the art will recognize that changes may be made in form and detail without departing from the spirit and scope of the disclosure.

The invention claimed is:

1. A multi-use cart comprising:

a collapsible frame comprising a pair of adjacent and spaced apart front side supports and a pair of adjacent and spaced apart rear side supports, the front and rear supports also spaced apart so as to provide an open space within the framework;

a plurality of storage compartments supported on the frame; and a tabletop supported on the frame, wherein the plurality of storage compartments are provided below the tabletop and wherein the plurality of storage compartments comprise at least one soft-sided bucket for storage and the tabletop comprises a hard flat surface, wherein the plurality of storage compartments comprise a plurality of buckets, pocket, bags, or a combination thereof vertically spaced apart along the height of the frame work and positioned within the open space within the framework; and wherein the plurality of storage compartments further comprises one or more bags, pockets, buckets, coolers or combinations thereof and wherein the one or more bags, pockets, buckets, coolers or combinations thereof are secured to only one side support or between only one pair of adjacent side supports.

2. The multi-use cart of claim 1 wherein the frame has a height and wherein the side supports are collapsibly connected such that in a collapsed position the open space within the framework has first dimensions and in an expanded position the open space within the frame work has second dimensions wherein the second dimensions are greater than the first dimensions and wherein the frame further comprises at least one locking mechanism to secure the frame in one or both of the expanded and collapsed positions.

3. The multi-use cart of claim 1 wherein the table top is positioned at a top portion of the framework and is supported over the open space and storage compartments there below.

4. The multi-use cart of claim 1 wherein the plurality of storage compartments comprise storage compartments comprised of fabric, canvas, mesh or a combination thereof.

5. The multi-use cart of claim 1 wherein the tabletop is a molded plastic material and wherein the tabletop comprises one or more recesses configured to vertically support a beverage container thereon.

6. The multi-use cart of claim 5 wherein the tabletop further comprises a perimeter lip.

7. The multi-use cart of claim 1 wherein the tabletop comprises a first substantially flat surface and a second substantially flat surface wherein the second substantially flat surface is provided to increase a surface area of the tabletop when the second substantially flat surface is in use.

8. The multi-use cart of claim 3 and wherein the tabletop comprises a first substantially flat surface and a second substantially flat surface wherein the second substantially flat surface is provided to increase a surface area of the tabletop when the second substantially flat surface is in use and wherein the second substantially flat surface extends beyond the frame when in use.

9. A tabletop for a wagon or wheeled cart comprising:

a top surface for supporting one or more items thereon, the top surface comprising a substantially flat surface area, a raised perimeter edge to the top surface, and one or more cavities in the top surface configured for holding a beverage container;

two or more legs pivotally connected to a bottom surface of the tabletop wherein the two or more legs are positioned to support the tabletop on two or more sides of the tabletop, wherein the legs extend outwardly from connection with the bottom surface of the table top at an angle and wherein the legs have a length such that the tabletop is configured to fit within an open area on a support surface of a wheeled cart and be supported therein for converting the wheeled cart to a wheeled tabletop and wherein the one or more legs are adjustable in length; and one or more storage compartments removably secured to the tabletop and positioned on one or more sides of the tabletop to provide storage adjacent to the tabletop, wherein the tabletop and the one or more storage compartments secured thereto are constructed from different materials.

10. The tabletop of claim 9 wherein the one or more storage compartments extend along one or more perimeter sides of the tabletop and hang therefrom.

11. The tabletop of claim 9 and further comprising one or more straps for the one or more legs and configured to secure the one or more legs to a surface of the wagon or wheeled cart.

12. The tabletop of 9 wherein a distance between adjacent legs is adjustable for installing the tabletop on the wagon or wheeled cart in a manner wherein the legs are secured to the wagon or wheeled cart by way of direct contact with one or more upright surfaces of the one or more legs with one or more surfaces of the wagon or wheeled cart.

13. The tabletop of claim 9 comprising a coupling mechanism provided around a perimeter of the table top and configured for removable coupling to a corresponding coupling mechanism provided on an upper surface of one or more storage components such that the arrangement of one or more storage components coupled to the table top is customizable.

14. The tabletop of claim 9 wherein the table top is configured to be supported on a floor surface of a wheeled cart and wherein a vertical spacing between the floor surface and the table top is adjustable by way of adjusting a length of the one or more legs such that items of varying dimensions may be supported on the floor of the wheeled cart while the tabletop is supported thereon.

15. The table top of claim 9 wherein the table top comprises two sections that are hingedly connected such that the table top is foldable.

16. The table top of claim 9 wherein the table top comprises one or more access openings having a section of table top surface pivotally connected to the table top such that the access opening comprises a door providing access to an interior of the cart below the table top.

* * * * *